US011246356B2

(12) United States Patent
Anderson

(10) Patent No.: US 11,246,356 B2
(45) Date of Patent: Feb. 15, 2022

(54) SPORTS WAVE BAG AND ITS USE

(71) Applicant: Wilken A. Anderson, Akron, OH (US)

(72) Inventor: Wilken A. Anderson, Akron, OH (US)

( * ) Notice: Subject to any disclaimer, the term of this patent is extended or adjusted under 35 U.S.C. 154(b) by 0 days.

(21) Appl. No.: 16/449,775

(22) Filed: Jun. 24, 2019

(65) Prior Publication Data

US 2019/0387815 A1 Dec. 26, 2019

Related U.S. Application Data

(60) Provisional application No. 62/689,503, filed on Jun. 25, 2018.

(51) Int. Cl.
*A41D 3/00* (2006.01)

(52) U.S. Cl.
CPC ..... *A41D 3/00* (2013.01); *A41D 2300/50* (2013.01)

(58) Field of Classification Search
CPC .. A41D 3/00; A41D 2300/50; A41D 2200/20; A41D 15/04; A41D 3/08; A41D 7/008; A41D 15/00; A41D 13/04; A47K 10/02; A41B 13/10; A41B 13/103; A41B 13/106; G09F 21/02; A45D 44/082
USPC ..... 2/69
See application file for complete search history.

(56) References Cited

U.S. PATENT DOCUMENTS 4,646,365 A * 3/1987 Suprise ..... A41B 13/10 2/49.2
8,166,571 B2 * 5/2012 Fletcher ..... A41B 13/103 2/48
9,440,160 B1 * 9/2016 Isra-El ..... A63H 33/22
2017/0143046 A1 * 5/2017 Giannakakis ..... A61F 5/3723

* cited by examiner

*Primary Examiner* — F Griffin Hall
(74) *Attorney, Agent, or Firm* — Renner, Kenner, Greive, Bobak, Taylor & Weber Co., L.P.A.

(57) ABSTRACT

A sports wave bag consists of an open bag formed by the overlayment and stitching of two pieces of cloth around three edges thereof. The pieces of cloth are selectively of the team colors of a sports team. At one end of the bag is a pair of handles and at the other end is an opening through which a fan may pass his head. The sports fan may be seated with his hands received in the bag and gripping the handles at the far end thereof, exposing a first color of the sports team. In executing "the wave," the fan stands to his feet and, while doing so, lifts his arms above his head to expose the other piece of cloth of the second team color. The effect is adding vibrancy of color and color change to the motion of "the wave" when performed at sporting events.

6 Claims, 6 Drawing Sheets

SPORTS WAVE BAG AND ITS USE

CROSS-REFERENCE TO RELATED APPLICATION

This application claims priority to U.S. Provisional Patent Application Ser. No. 62/689,503, filed Jun. 25, 2018, entitled "Sports Wave Bag and Its Use."

TECHNICAL FIELD

The invention herein resides in the art of wearing apparel and, more particularly, to sports apparel to be donned by sports fans. Specifically, the invention relates to a piece of apparel and its use during the performance of "the wave," as commonly practiced by fans at sporting events.

BACKGROUND OF THE INVENTION

Those who attend sporting events held in a seated venue, such as an arena, stadium or the like, often engage in what is known as "the wave." During "the wave," seated fans in the arena or stadium progressively and sequentially rise to their feet, stand for but a few seconds, and re-seat themselves, with that exercise proceeding uniformly about the arena or stadium giving the appearance of a three-dimensional wave progressing about the venue. The activity is typically enhanced by the fans raising their arms as they stand, and lowering their arms as they re-seat themselves, adding to the replication of a wave. "The wave" is best effected when the fans stand and re-seat themselves in alignment and sequentially about a substantial portion of the venue, if not its entirety.

While "the wave" is, by itself, quite compelling and awe-inspiring, it is possible, within the confines of the instant invention, to enhance its appearance and effectiveness. Presently, the impact of "the wave" comes from its motion alone, but there is little vibrancy given to it by means of color. While fans often wear a color or some memorabilia representing the team they support, there is rarely any uniformity of color present in the stands. This is understandable since team colors generally comprise two distinct colors and the shirts, jackets, hats and the like that fans typically wear often include other colors, as well. Moreover, "the wave" is not given to a change of color during "the wave" process.

It is most desirable to provide a uniform wearing apparel particularly adapted for wearing during "the wave" to effect a visual appearance enhanced by color, and changing color, rather than motion alone.

SUMMARY OF THE INVENTION

In light of the foregoing, it is a first aspect of the invention to provide a sports wave bag that can be quickly and easily donned by sports fans.

Another aspect of the invention is the provision of a sports wave bag, which is multi-colored, having a front piece of a first color and a back piece of a second color, the two colors being the team colors of an associated sports team.

Yet another aspect of the invention is the provision of a sports wave bag that can provide comfort and protection from the elements to the wearer.

A further aspect of the invention is the provision of a sports wave bag that has interior grips such that, in use, the sports fan wearing the bag can quickly and easily maneuver it while performing "the wave."

Still a further aspect of the invention is the provision of a sports wave bag that can serve as a tote for seat pads, additional wearing apparel and the like when traveling to and from the game.

An additional aspect of the invention is the provision of a sports wave bag having different team colors on opposite sides to effect a change of color during its use in performing "the wave."

Yet a further aspect of the invention is the provision of a sports wave bag that is simple and cost-effective to construct from state-of-the-art materials.

The foregoing and other aspects of the invention which will become apparent herein are achieved by sports apparel for use in performing the wave at sporting events, comprising: a front panel; a back panel secured to said front panel and forming a bag having a cavity between said first and back panels; and means within a first end of said bag for secured engagement by a user's hands.

Further aspects of the invention are achieved by a method for a sports fan to participate in the wave at a sporting event, comprising: placing the hands and arms of the sports fan in a bag having a front side and a back side, each of a different one of a sports team's colors; placing the head of the sports fan through an aperture of the front side; gripping handles at a bottom of the bag; and on command, the sports van rises from a sitting position exposing the front side of the bag to a standing position with the sports fan's arms raised above his/her head, exposing the back side of the bag.

BRIEF DESCRIPTION OF THE DRAWINGS

For an understanding of the various aspects of the invention, reference should be made to the following detailed description and accompanying drawings wherein.

BEST MODE FOR CARRYING OUT THE INVENTION

Figure 1:
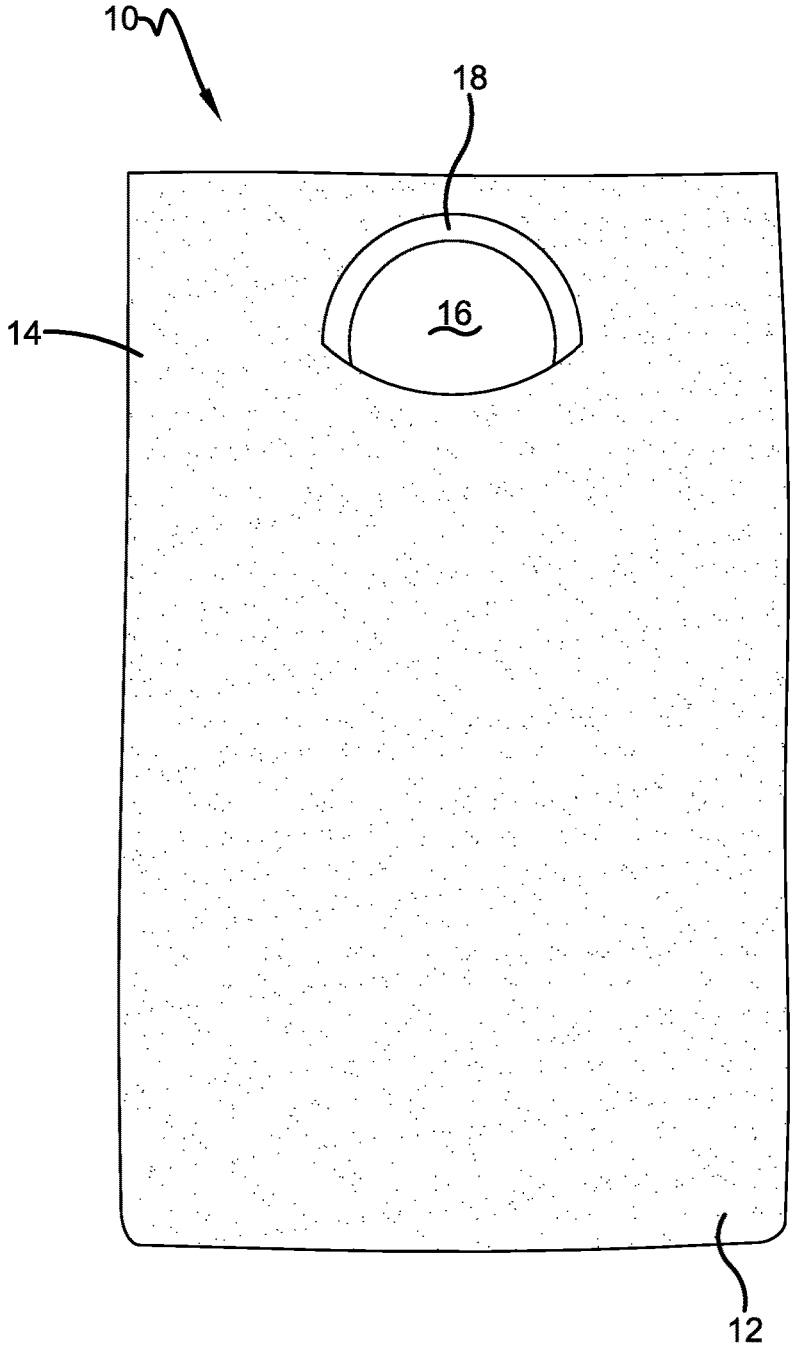
FIG. 1 is a top plan view of the sports wave bag of the invention.
Figure 2:
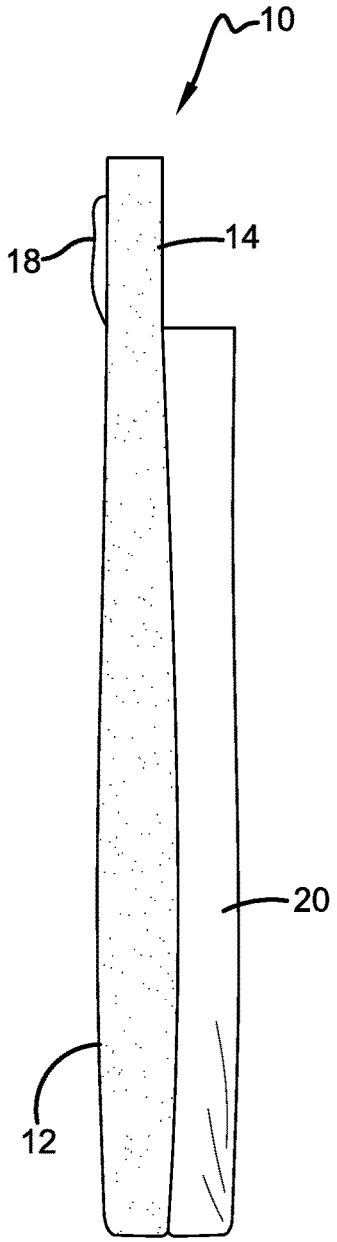
FIG. 2 is a side elevational view of the sports wave bag of FIG. 1.

Referring now to the drawings, and more particularly FIGS. 1 and 2, it can be seen that a sports wave bag made in accordance with the invention is designated generally by the numeral 10. The wave bag 10 includes a front piece 12, preferably of cloth, and most preferably of a synthetic fleece or the like to provide warmth to the user. A shoulder area 14 is provided at the top of the front piece 12, and is characterized by an aperture 16 therein. About the aperture 16 is a crescent-shaped collar 18, which, most preferably is filled with an appropriate material such as cloth or fiber to provide comfort and support to the back of the neck of the wearer.

As best seen in FIG. 2, a back piece 20, again of an appropriate cloth or fabric, such as the front piece 12, is stitched or seamed as at 22 to the front piece 12. As will become apparent, the seam 22 passes about three of the four edges of the back piece 20, securing them to the front piece 12, and thereby forming an open-ended bag therebetween.

Figure 3:
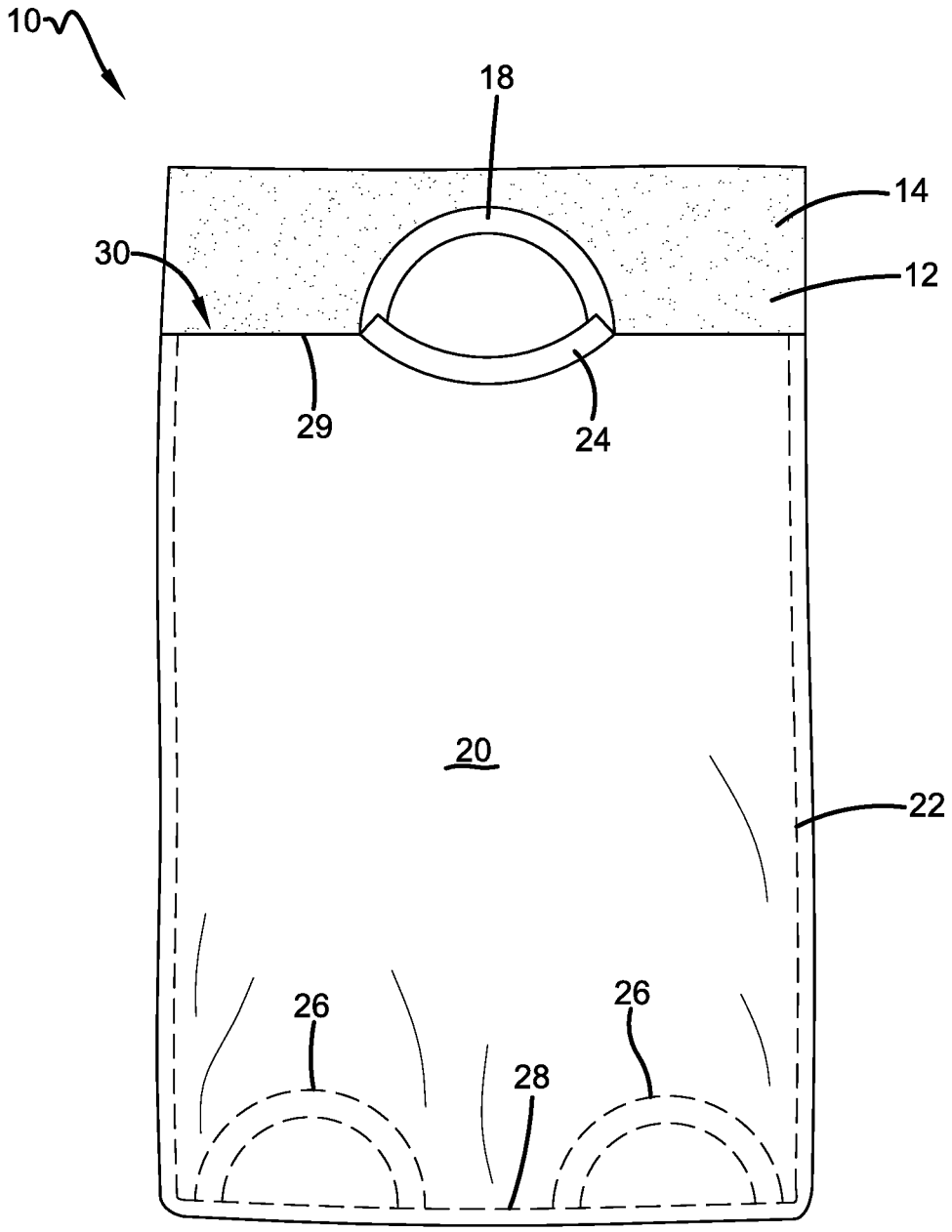
FIG. 3 is a plan view of the back of the sports wave bag of the invention showing the internal handles in phantom.

As best seen in FIG. 3, a neck band 24 is provided as a portion of the back piece 20 and is positioned to engage the front neck portion of the wearer. A pair of handles 26, shown in phantom in FIG. 3, is connected to the seam 22 at the bottom of the wave bag 10 and positioned to be secured by the hands of the wearer, as will become apparent below. These handles 26 are tubular in nature and are either fiber or cloth-filled, and are stitched at their ends to the bottom interior edge of the joinder of the front piece 12 with the back piece 20. Finally, and as discussed above, the top edge 29 of the back piece 20 is not sewn or stitched to the front piece 12, but rather that edge is left open, such that the edge 29 and its included neck band 24 define an opening 30 extending from side to side at the top of the back piece 20, thus defining a bag construction with the three other edges being seamed as at 22.

Figure 4:
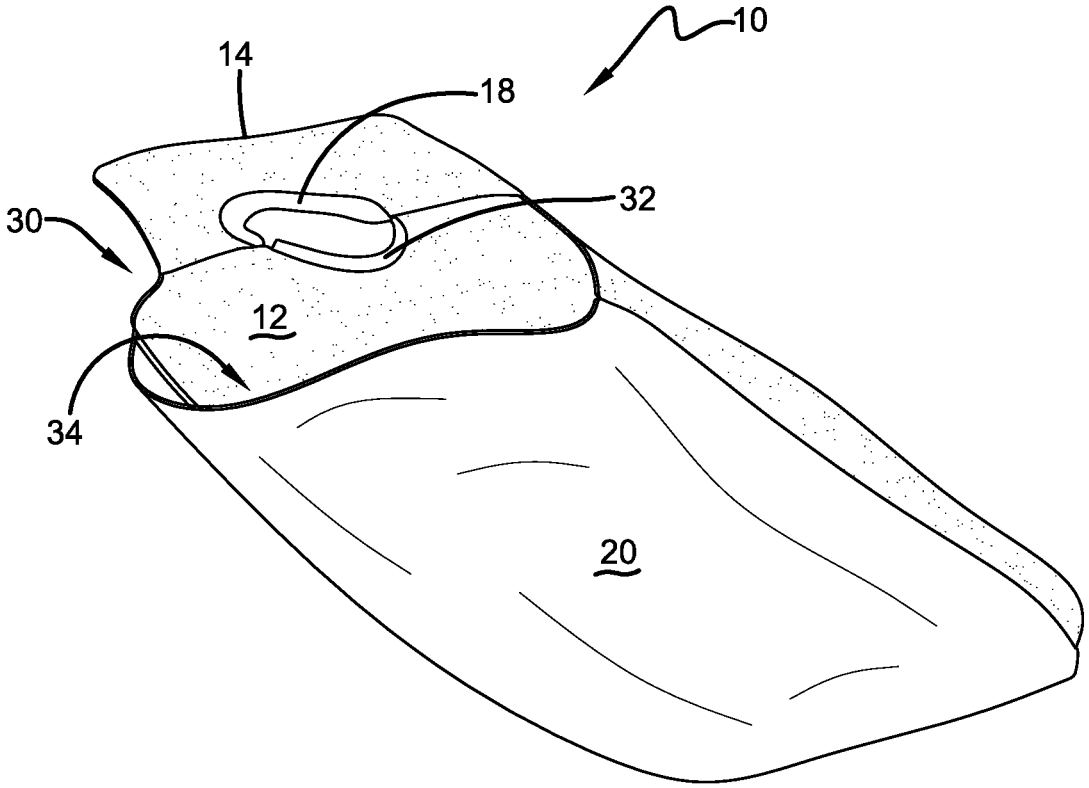
FIG. 4 is an illustrative view of the sports wave bag of the invention showing the same as opened.

As shown in FIG. 4, the wave bag 10 is positioned in an opened orientation, showing a neck band 32 as part and parcel of the front piece 12 and showing the opening 30 allowing access into the cavity 34 of the sports wave bag 10.

Figure 5:
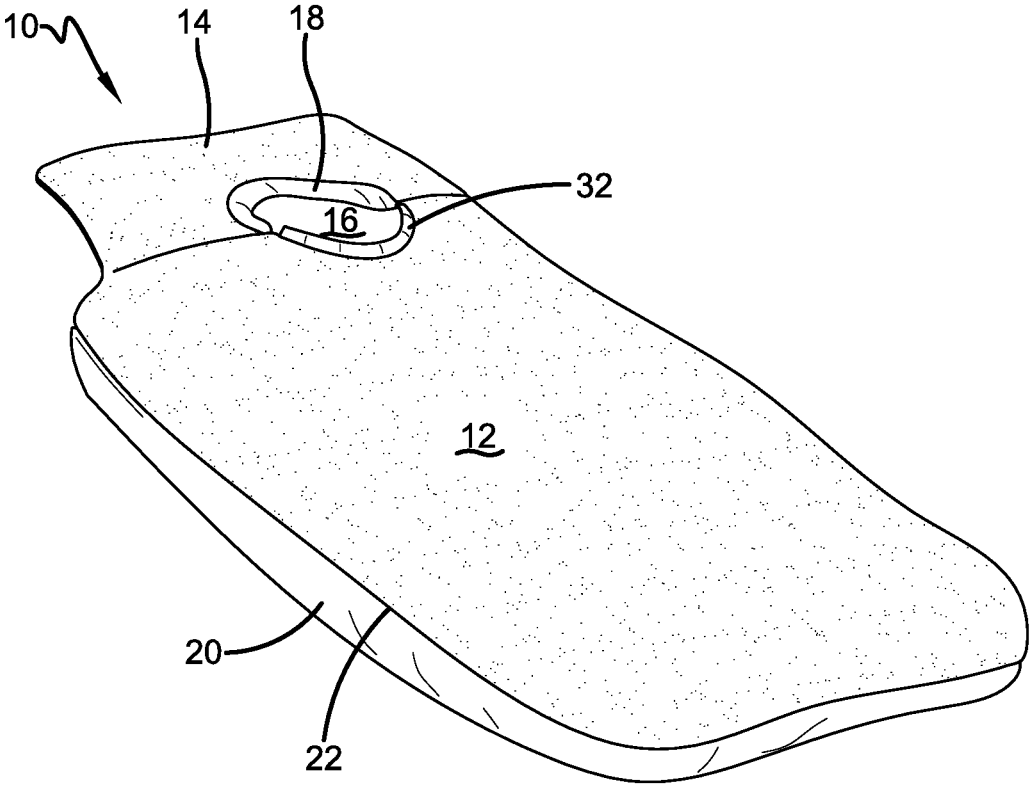
FIG. 5 is a perspective view of the sports wave bag of the invention from the front thereof.

With reference to FIG. 5, the bag is shown with the front piece 12 and its associated shoulder area piece 14 being on top and the back piece 20 facing downwardly. As shown, the crescent-shaped collar 18 and neck band 32 defining the aperture 16 through which the wearer's head may pass.

Figure 6:
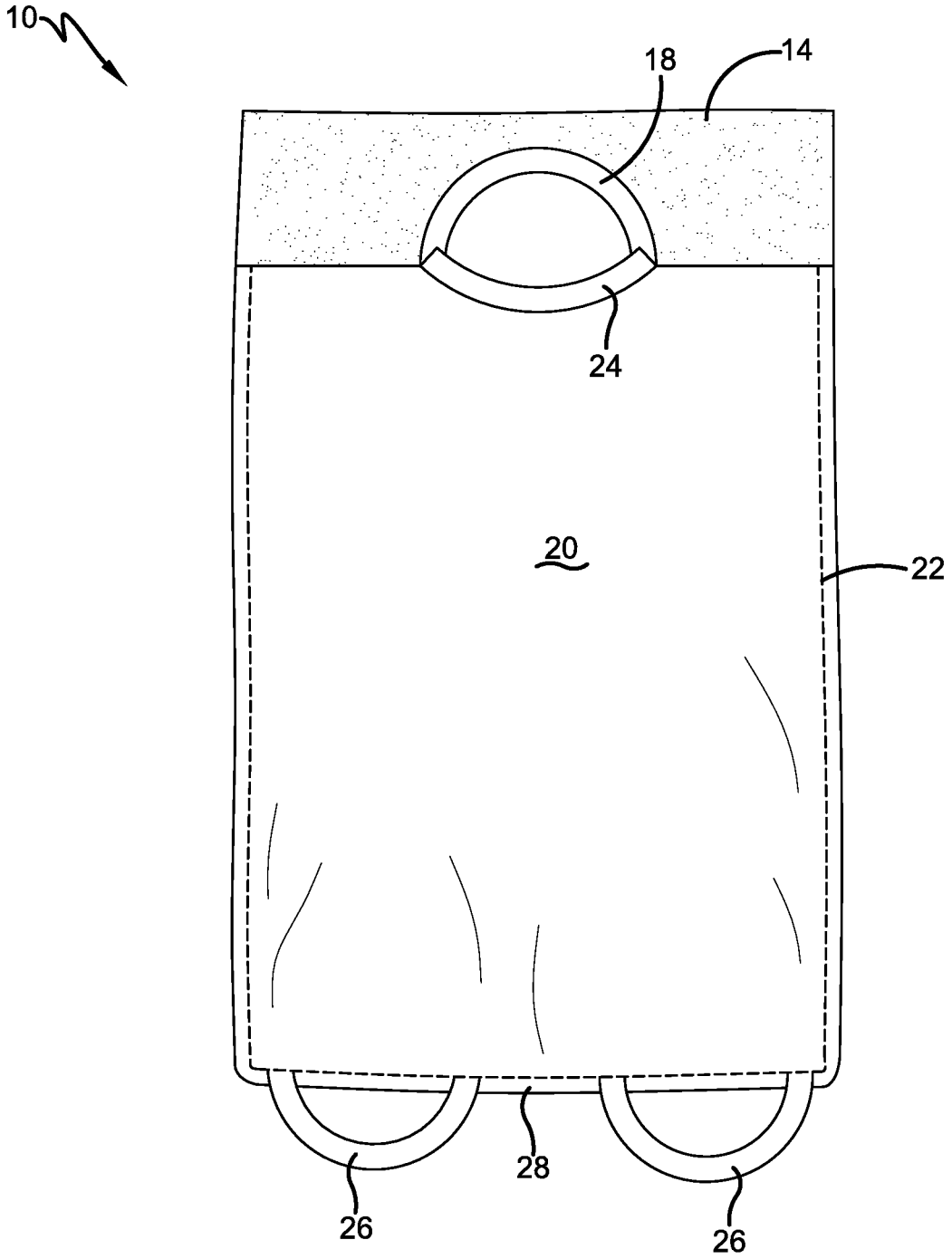
FIG. 6 is a top plan view of the sports wave bag of the invention showing the same turned inside out.

FIG. 6 shows the sports wave bag 10 turned inside out, showing the looped handles 26 connected to the bottom interior edge 28 of interconnection between the front piece 12 and back piece 20, the two pieces being interconnected by a seam or stitching 22. Again, the handles 26 are tubular in nature and are filled with an appropriate cloth or fiber to provide firmness for gripping by the user.

Figure 7:
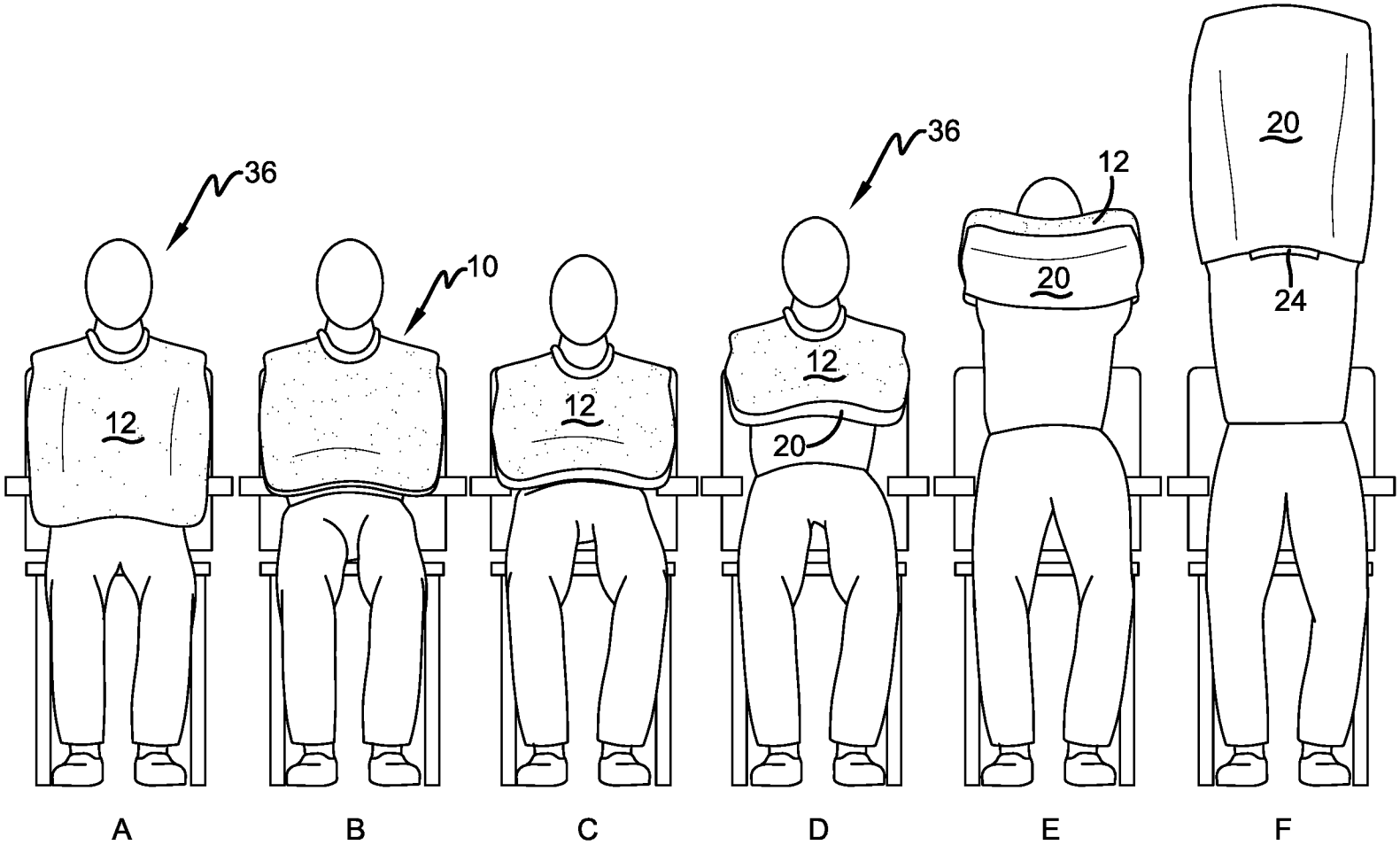
FIG. 7 shows the implementation of the sports wave bag of the invention in use.

With reference now to FIG. 7, the actual use of the sports wave bag 10 in effecting a wave can be seen. At position A, the wearer 36 is seated in an arena or stadium with his arms and hands passing through the opening 30 and into the cavity 34. In contemplation of a "wave," the wearer's hands grip the pair of handles 26.

At position B, "the wave" commences with the fan 36 beginning to lift his hands as shown.

The lifting continues progressively through positions C, D, and E, where the back piece 20 is beginning to be substantially exposed.

At the final position F, the back piece or panel 20 is fully exposed and then the sequence proceeds in the return order of E, D, C, B, and A as the fan returns to the seat.

It will be appreciated by those skilled in the art that most sports teams have two colors associated with the team uniform. For example, the Cleveland Cavaliers' colors are wine and gold. According to the instant invention, implementation of the sports wave bag 10 for the Cleveland Cavaliers would have one of the pieces 12 in the wine color, and the other piece 20 in the gold color or, alternatively, the front piece 12 in gold and the back piece 20 in wine. Accordingly, before "the wave" commences, the stadium will substantially show the color apparent from position A, where at the midpoint of "the wave," at position F, the stadium will substantially show the opposite color. Accordingly, "the wave" is given vibrancy of color and color change in addition to three-dimensional movement replicating a fluid wave.

It will be appreciated that the sports wave bag 10 may be quite quickly donned by the fan simply slipping his arms into the cavity 34 and passing his head through aperture 16. Nothing more is required. Similarly, it can be as easily removed. Accordingly, while it is contemplated that "the wave" bag may serve as a piece of protective apparel, it may be removed, if desired, for purposes of comfort.

It will also be appreciated that the sports wave bag 10 may be used as a duffel bag of sorts, for carrying signs, foam fingers, streamers, additional wearing apparel, and the like to and from the game.

Thus it can be seen that the various aspects of the invention have been satisfied by the structure and procedure presented above. While in accordance with the patent statutes only the best mode and preferred embodiments of the invention have been presented and described in detail, the invention is not limited thereto or thereby. Accordingly, for a true appreciation of the scope and breadth of the invention, reference should be made to the following claims.

What is claimed is:

1. Sports apparel for use in performing the wave at sporting events, comprising:

a front panel;

a back panel secured to said front panel and forming a bag having a cavity between said front and back panels, said bad having a closed first end and an open second end opposite the first end;

means within said first end of said bag for secured engagement by a user's hands, said means for secured engagement by a user's hands comprising spaced-apart closed-loop handles secured within said bag between said front and back panels at said first end of said bag; and wherein said front and back panels are of different colors, said different colors being the team colors of an associated sports team.

2. The sports apparel for use in performing the wave according to claim 1, wherein said front panel is longer than said back panel and extends beyond said back panel at said open second end of said bag.

3. The sports apparel for use in performing the wave according to claim 2, wherein said front panel has an aperture therein where said front panel extends beyond said back panel.

4. The sports apparel for use in performing the wave according to claim 3, wherein said aperture has a collar about a periphery thereof and wherein said back panel has a neck band adjacent said collar.

5. The sports apparel for use in performing the wave according to claim 3, wherein said front and back panels are rectangular, overlaying and secured to each other about three edges thereof and being unattached at the fourth edge thereof forming said open second end of said bag.

6. A method for a sports fan to participate in the wave at a sporting event, comprising:

placing the hands and arms of the sports fan into a bag having a front side and a back side, each of a different one of a sports team's colors;

placing the head of the sports fan through an aperture of the front side;

gripping spaced-apart closed-loop handles located inside the bag at a closed bottom of the bag, opposite an open top of the bag; and on command, the sports fan rises from a sitting position exposing the front side of the bag to a standing position with the sports fan's arms raised above his/her head, exposing the back side of the bag.

* * * * *